US008528244B2

(12) United States Patent
Scallie et al.

(10) Patent No.: US 8,528,244 B2
(45) Date of Patent: Sep. 10, 2013

(54) SYSTEM AND METHOD FOR WEAPONS INSTRUMENTATION TECHNIQUE

(76) Inventors: Laurent Scallie, Honolulu, HI (US); Ken James McClain, Floresville, TX (US)

( * ) Notice: Subject to any disclaimer, the term of this patent is extended or adjusted under 35 U.S.C. 154(b) by 0 days.

(21) Appl. No.: 12/785,046

(22) Filed: May 21, 2010

(65) Prior Publication Data

US 2011/0283586 A1 Nov. 24, 2011

(51) Int. Cl.
*F41A 33/00* (2006.01)

(52) U.S. Cl.
USPC ..... 42/84; 434/16

(58) Field of Classification Search
USPC ..... 42/106, 1.01, 84; 434/16
See application file for complete search history.

(56) References Cited

U.S. PATENT DOCUMENTS

| | | | | |
|---|---|---|---|---|
| 4,416,631 | A | 11/1983 | Dawson et al. | |
| 7,335,026 | B2 * | 2/2008 | Goree et al. | 434/22 |
| 7,568,304 | B1 * | 8/2009 | Moody et al. | 42/72 |
| 7,661,217 | B2 * | 2/2010 | Pikielny | 42/1.01 |
| 2005/0181335 | A1 * | 8/2005 | Lvovskiy | 434/16 |
| 2005/0191601 | A1 | 9/2005 | Dvorak | |
| 2008/0010890 | A1 * | 1/2008 | Vice et al. | 42/72 |
| 2008/0032268 | A1 * | 2/2008 | Farrell et al. | 434/16 |
| 2008/0063400 | A1 | 3/2008 | Hudson et al. | |
| 2008/0233543 | A1 | 9/2008 | Guissin | |
| 2008/0282595 | A1 * | 11/2008 | Clark et al. | 42/1.01 |
| 2009/0232506 | A1 | 9/2009 | Hudson et al. | |
| 2009/0255160 | A1 * | 10/2009 | Summers | 42/70.01 |
| 2010/0031552 | A1 * | 2/2010 | Houde-Walter | 42/72 |
| 2011/0162245 | A1 * | 7/2011 | Kamal et al. | 42/1.01 |

* cited by examiner

*Primary Examiner* — Benjamin P Lee
(74) *Attorney, Agent, or Firm* — James M Smedley LLC; James M. Smedley, Esq.

(57) ABSTRACT

A system and method for modifying a weapon with an inexpensive and easily removable attachment that is capable of recording information related to the use of the weapon and transmitting that data to a remote computing device by wired or wireless transmission means. The attachment includes one or more sensors able to record various changes and operations related to settings and usage of the modified weapon. The attachment also includes a module that contains electronics capable of one or more of the following: (i) receiving data from the one or more sensors; (ii) storing data received from the sensors; (iii) transmitting the data received from the sensors or stored data to a computing device via a wired or wireless connection.

14 Claims, 14 Drawing Sheets

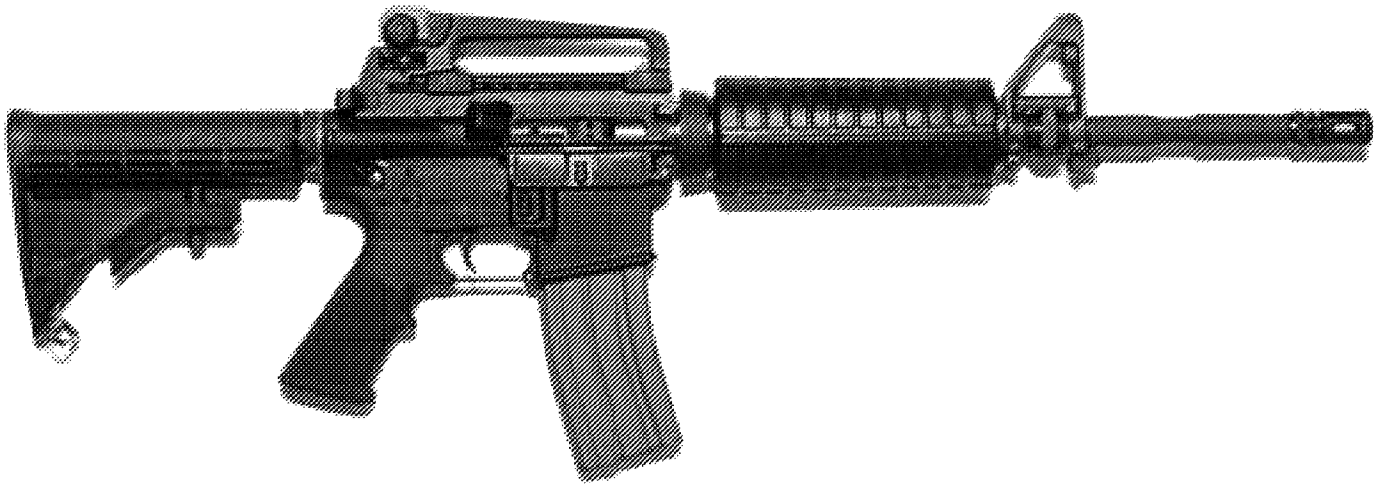
Fig. 1 - Prior Art

231

SYSTEM AND METHOD FOR WEAPONS INSTRUMENTATION TECHNIQUE

FIELD OF THE INVENTION

The present invention relates to a general technique for modifying weapons for interaction with a simulated training system. The present invention further relates to a general technique for modifying weapons for recording and/or transmitting data related to live use of the weapons.

BACKGROUND OF THE INVENTION

Modern dismounted infantry training systems have become a useful and effective way to train soldiers prior to and during deployments. Soldiers, police and contracted security forces all have begun to use simulated training systems to teach firearm skills and tactics to trainees and veterans alike. The objective of any simulated training system is to create as realistic a situation as possible.

Many simulated training systems use virtual reality simulators in conjunction with modified or simulated weapons configured to interact with the virtual reality simulator. The modified or simulated weapons capture data about how the weapon is used and send that data to a computing device that uses the data to produce interactions with the simulated training system. One of the goals of the modified or simulated weapons used in these training systems is to mimic the use of the weapon as it would be used in the field. The current state of the art is to use mock-ups that look and feel as close to the real weapons as possible or to make significant modifications to a real weapon that typically prevent the weapon from live fire use.

The problem with mock-ups, or simulated weapons, is that they can be extremely expensive and will never truly match the look, feel and operation of a real weapon. Furthermore, they can only ever be used in a simulated training system and serve no other real world application.

The problem with prior art systems that make modifications to real weapons for use in a simulated training system is that they are very costly and typically render the weapon incapable of live fire use without first being modified back into a live fire weapon. Most of these modifications require internal modification of the weapon or special barrel mounted solutions that require significant time and skill to attach. Furthermore, in prior art system that do not render the weapon incapable of live fire, the modifications serve no purpose outside of a simulated training system.

Therefore, there is a need in the art to provide an inexpensive and easily attachable/detachable weapon modification system that modifies a weapon capable of live fire for use in a simulated training system without rendering the weapon incapable of live fire use. There is a further need in the art to provide an inexpensive and easily attachable/detachable weapon modification system that can provide beneficial data capture, recording and transmission from a live fire weapon to either a simulated training system or a field use recording system.

SUMMARY OF THE INVENTION

In one embodiment of the invention, there is provided a system and method for modifying a weapon with an inexpensive and easily removable attachment that is capable of recording information related to the use of the weapon and transmitting that data to a remote computing device by wired or wireless transmission means. The attachment includes one or more sensors able to record various changes and operations related to settings and usage of the modified weapon. The attachment also includes a module that contains electronics capable of one or more of the following: (i) receiving data from the one or more sensors; (ii) storing data received from the sensors; (iii) transmitting the data received from the sensors or stored data to a computing device via a wired or wireless connection.

BRIEF DESCRIPTION OF THE DRAWINGS

FIG. 1 is a drawing of a prior art unmodified Colt® M4 5.56 mm Carbine.

DETAILED DESCRIPTION OF THE INVENTION

Figures 2A, 2B, 2C, 2D, 2E, 2F:
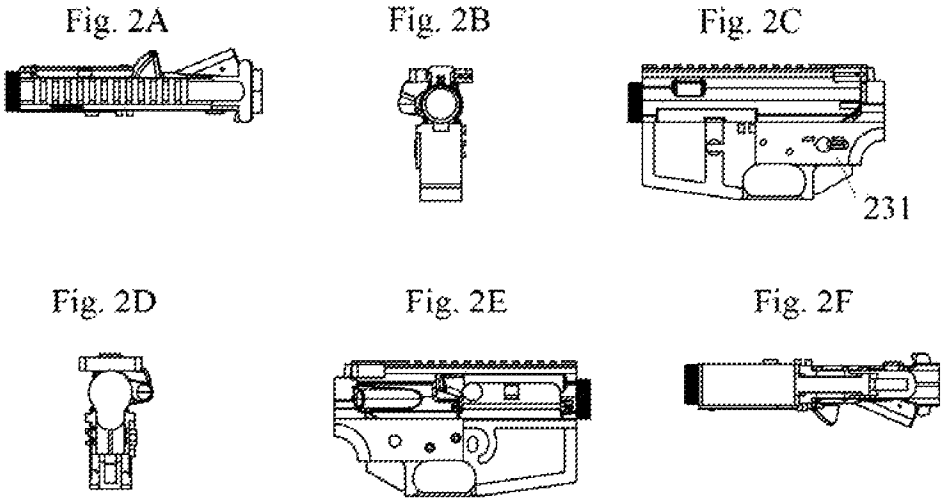
FIG. 2A is a drawing of the top view of a receiver belonging to a prior art unmodified Colt® M4 5.56 mm Carbine.
FIG. 2B is a drawing of the front view of a receiver belonging to a prior art unmodified Colt® M4 5.56 mm Carbine.
FIG. 2C is a drawing of the selector side view of a receiver belonging to a prior art unmodified Colt® M4 5.56 mm Carbine.
FIG. 2D is a drawing of the rear view of a receiver belonging to a prior art unmodified Colt® M4 5.56 mm Carbine.
FIG. 2E is a drawing of the ejector side view of a receiver belonging to a prior art unmodified Colt® M4 5.56 mm Carbine.
FIG. 2F is a drawing of the bottom view of a receiver belonging to a prior art unmodified Colt® M4 5.56 mm Carbine.
Figure 3A:
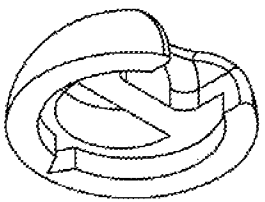
FIG. 3A is a drawing of a view of a selector switch sensor and sensor mount appropriate for the Colt® M4 5.56 mm Carbine in accordance with one embodiment of the present invention.
Figure 3B:
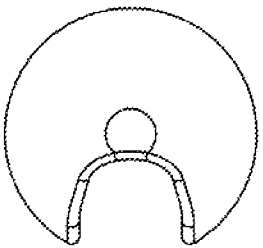
FIG. 3B is a drawing of the top view of a selector switch sensor and sensor mount appropriate for the Colt® M4 5.56 mm Carbine in accordance with one embodiment of the present invention.
Figure 3C:
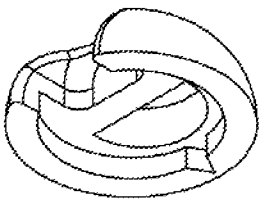
FIG. 3C is a drawing of a view of a selector switch sensor and sensor mount appropriate for the Colt® M4 5.56 mm Carbine in accordance with one embodiment of the present invention.
Figure 3D:
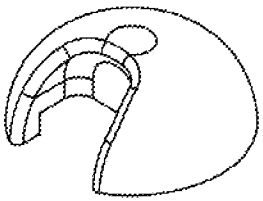
FIG. 3D is a drawing of a view of a selector switch sensor and sensor mount appropriate for the Colt® M4 5.56 mm Carbine in accordance with one embodiment of the present invention.
Figure 3E:
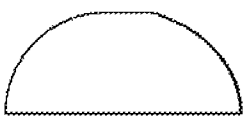
FIG. 3E is a drawing of the side view of a selector switch sensor and sensor mount appropriate for the Colt® M4 5.56 mm Carbine in accordance with one embodiment of the present invention.
Figure 3F:
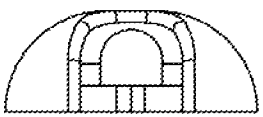
FIG. 3F is a drawing of the cross-sectional side view of a selector switch sensor and sensor mount appropriate for the Colt® M4 5.56 mm Carbine in accordance with one embodiment of the present invention.
Figure 3G:
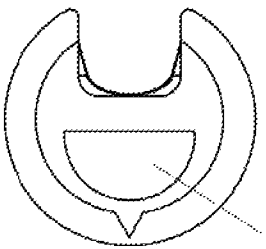
FIG. 3G is a drawing of the bottom view of a selector switch sensor and sensor mount appropriate for the Colt® M4 5.56 mm Carbine in accordance with one embodiment of the present invention.
Figure 4C:
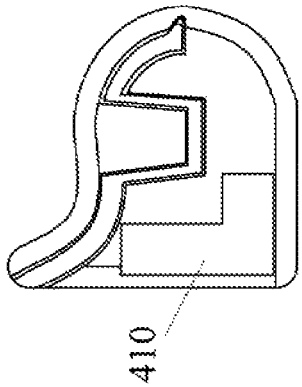
FIG. 4C is a drawing of the inside side view of a charger sensor and sensor mount appropriate for the Colt® M4 5.56 mm Carbine in accordance with one embodiment of the present invention.
Figure 4B:
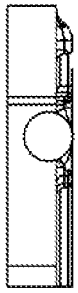
FIG. 4B is a drawing of the bottom view of a charger sensor and sensor mount appropriate for the Colt® M4 5.56 mm Carbine in accordance with one embodiment of the present invention.
Figure 4A:
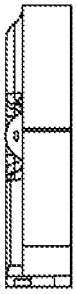
FIG. 4A is a drawing of the top view of a charger sensor and sensor mount appropriate for the Colt® M4 5.56 mm Carbine in accordance with one embodiment of the present invention.
Figure 4G:
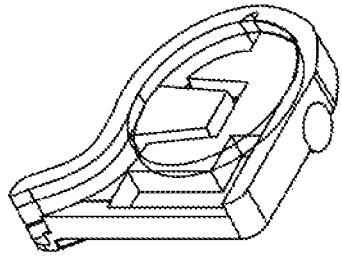
FIG. 4G is a drawing of a side view of a charger sensor and sensor mount appropriate for the Colt® M4 5.56 mm Carbine in accordance with one embodiment of the present invention.
Figure 4F:
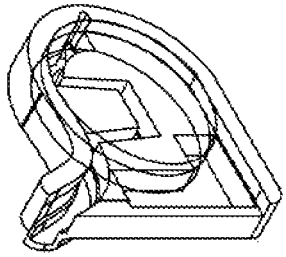
FIG. 4F is a drawing of a side view of a charger sensor and sensor mount appropriate for the Colt® M4 5.56 mm Carbine in accordance with one embodiment of the present invention.
Figure 4E:
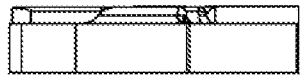
FIG. 4E is a drawing of the rear view of a charger sensor and sensor mount appropriate for the Colt® M4 5.56 mm Carbine in accordance with one embodiment of the present invention.
Figure 4D:
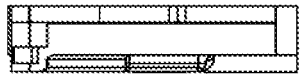
FIG. 4D is a drawing of the front view of a charger sensor and sensor mount appropriate for the Colt® M4 5.56 mm Carbine in accordance with one embodiment of the present invention.
Figure 5A:
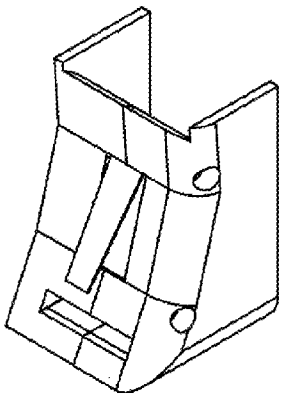
FIG. 5A is a drawing of a side view of a charger sensor and sensor mount appropriate for the Colt® M4 5.56 mm Carbine in accordance with one embodiment of the present invention.
Figure 5B:
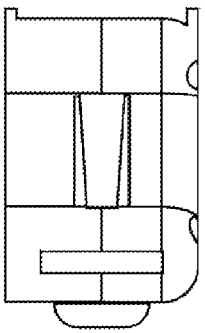
FIG. 5B is a drawing of a front view of a charger sensor and sensor mount appropriate for the Colt® M4 5.56 mm Carbine in accordance with one embodiment of the present invention.
Figure 5C:
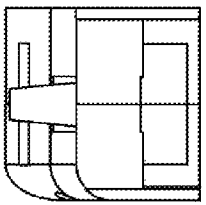
FIG. 5C is a drawing of a top view of a charger sensor and sensor mount appropriate for the Colt® M4 5.56 mm Carbine in accordance with one embodiment of the present invention.
Figure 5D:
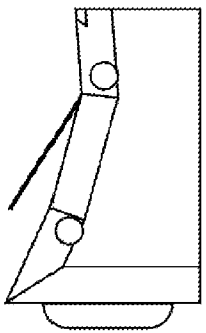
FIG. 5D is a drawing of a side view of a charger sensor and sensor mount appropriate for the Colt® M4 5.56 mm Carbine in accordance with one embodiment of the present invention.
Figure 5E:
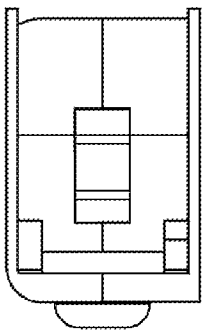
FIG. 5E is a drawing of a rear view of a charger sensor and sensor mount appropriate for the Colt® M4 5.56 mm Carbine in accordance with one embodiment of the present invention.

FIG. 1 shows a view of the ejector side of an unmodified Colt® M4 5.56 mm Carbine, one of the most commonly used small arms rifle in the United States Armed Forces and many other nations across the world. FIGS. 2A-2F shows many views of the receiver of an unmodified Colt® M4 5.56 mm Carbine.

For this application, references to the Colt® M4 5.56 mm Carbine are used throughout this specification. However, one of ordinary skill in the art would understand that any number of weapon systems could be modified in similar manners herein presented and embodiments of the present invention are contemplated for use with any weapon system According to an embodiment of the present invention, a weapon, such as the Colt® M4 5.56 mm Carbine shown in FIGS. 1 and 2, is modified by securing one or more sensors, a wiring harness and a control unit to the weapon. The sensors, wiring harness and control unit are communicatively connected in such a manner that various operations of a modified weapon may be processed. Operations include, but are not limited to, selecting a fire rate by changing the position of a selector switch, pulling of a trigger, identification of a firing direction and angle based upon the time a trigger was pulled, use of an ejector.

According to an embodiment of the present invention, the various operations of a modified weapon may be processed and stored in the control unit and/or transmitted via a wireless or wired network connection to a remote computing device (e.g., laptop, server, smartphone, desktop) for processing, storage and analysis.

According to an embodiment of the present invention, a remote computing device is able to transmit data to a modified weapon in order to simulate an action or cause the operability of the modified weapon to change. Examples of simulated actions or operability changes include, but are not limited to, simulation of a misfired round, simulation of a weapon jam, disablement of the weapons capability of firing. These kinds of actions are particularly useful in simulated training systems where the user of a weapon needs to learn how properly respond to these situations.

With respect to the sensors, numerous types of sensors may be utilized and attached to various components of the weapon. Examples of sensors that may be utilized in embodiments of the present invention include, but are not limited to, magnetic reed switches, microswitches, photocells and IR detectors.

FIGS. 3A-3G show multiple views of an exemplary embodiment of a sensor and a sensor attachment for a Colt® M4 5.56 mm Carbine selector switch. According to an embodiment of the invention, a magnetic sensor (e.g., in the cavity 310 under the dome in FIG. 3G) is contained within a selector switch sensor attachment.

The selector switch sensor attachment may be attached to a weapon through a variety of means. An exemplary embodiment for means of attaching the sensor attachment to a weapon is by way of placing an adhesive compound or tape between the selector switch sensor attachment and the selector switch of the weapon in a manner that does not impede the movement of the selector switch. Other means of securing the selector switch sensor attachment to the selector switch include, but are not limited to, "snapping" on a properly sized selector switch sensor attachment to the selector switch of a weapon.

FIGS. 4A-4G show multiple views of an exemplary embodiment of a sensor and sensor attachment for a Colt® M4 5.56 mm Carbine charger. According to an embodiment of the invention, two magnetic sensors are in the L shape region 410 contained within a sensor attachment 430.

The charger sensor attachment may be attached to a weapon through a variety of means. An exemplary embodiment for means of attaching the charger sensor attachment to a weapon is by way of placing an adhesive compound or tape between the charger sensor attachment and the charger of the weapon in a manner that does not impede the movement of the charger. Other means of securing the charger sensor attachment to the charger include, but are not limited to, "snapping" on a properly sized charger sensor attachment to the charger of a weapon.

FIGS. 5A-5E show multiple views of an exemplary embodiment of a sensor and sensor attachment for a Colt® M4 5.56 mm trigger. According to an embodiment of the present invention, a microswitch is used as a sensor and is placed under the trigger of a weapon.

The trigger sensor attachment may be attached to a weapon through a variety of means. An exemplary embodiment for means of attaching the trigger sensor attachment to a weapon is by way of placing an adhesive compound or tape between the trigger sensor attachment and the trigger grip of the weapon in a manner that does not impede the movement of the trigger. Other means of securing the trigger sensor attachment to the trigger include, but are not limited to, "snapping" on a properly sized trigger sensor attachment to the trigger grip of a weapon.

FIGS. 6A-6K show multiple views of an exemplary embodiment of a sensor and sensor attachment for a Colt® M4 5.56 mm butt stock. According to an embodiment of the present invention, a butt stock sensor and sensor attachment 610 and a IR butt stock sensor and sensor attachment 620 work in conjunction to sense if the butt stock is pressed against a user's shoulder or other surface.

Figure 6D:
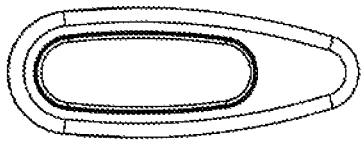
FIG. 6D is a drawing of a front view of a butt stock sensor and sensor mount appropriate for the Colt® M4 5.56 mm Carbine in accordance with one embodiment of the present invention.
Figure 6C:
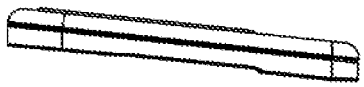
FIG. 6C is a drawing of a side view of a butt stock sensor and sensor mount appropriate for the Colt® M4 5.56 mm Carbine in accordance with one embodiment of the present invention.
Figure 6B:
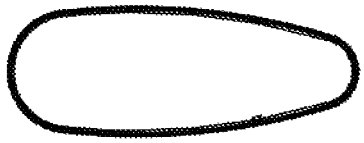
FIG. 6B is a drawing of a rear view of a butt stock sensor and sensor mount appropriate for the Colt® M4 5.56 mm Carbine in accordance with one embodiment of the present invention.
Figure 6A:
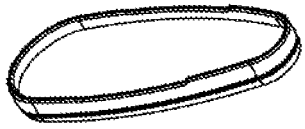
FIG. 6A is a drawing of a view of a butt stock sensor and sensor mount appropriate for the Colt® M4 5.56 mm Carbine in accordance with one embodiment of the present invention.
Figure 6G:
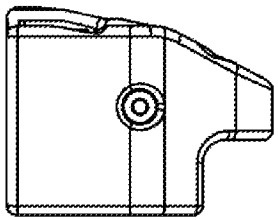
FIG. 6G is a drawing of a side view of a IR butt stock sensor and sensor mount appropriate for the Colt® M4 5.56 mm Carbine in accordance with one embodiment of the present invention.
Figure 6J:
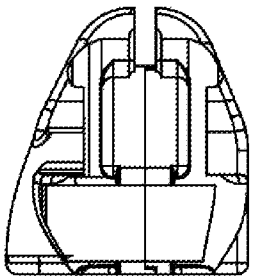
FIG. 6J is a drawing of a top view of a IR butt stock sensor and sensor mount appropriate for the Colt® M4 5.56 mm Carbine in accordance with one embodiment of the present invention.
Figure 6F:
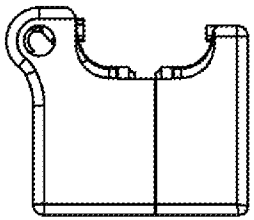
FIG. 6F is a drawing of a front view of a IR butt stock sensor and sensor mount appropriate for the Colt® M4 5.56 mm Carbine in accordance with one embodiment of the present invention.
Figure 6I:
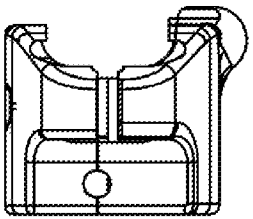
FIG. 6I is a drawing of a rear view of a IR butt stock sensor and sensor mount appropriate for the Colt® M4 5.56 mm Carbine in accordance with one embodiment of the present invention.
Figure 6E:
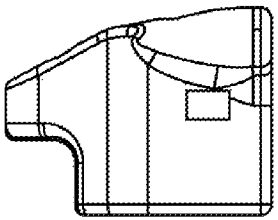
FIG. 6E is a drawing of a side view of a IR butt stock sensor and sensor mount appropriate for the Colt® M4 5.56 mm Carbine in accordance with one embodiment of the present invention.
Figure 6H:
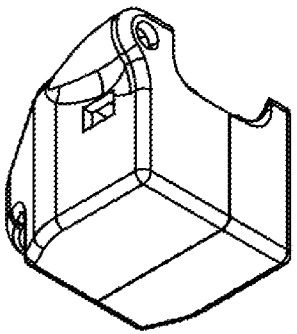
FIG. 6H is a drawing of a view of a IR butt stock sensor and sensor mount appropriate for the Colt® M4 5.56 mm Carbine in accordance with one embodiment of the present invention.
Figure 6K:
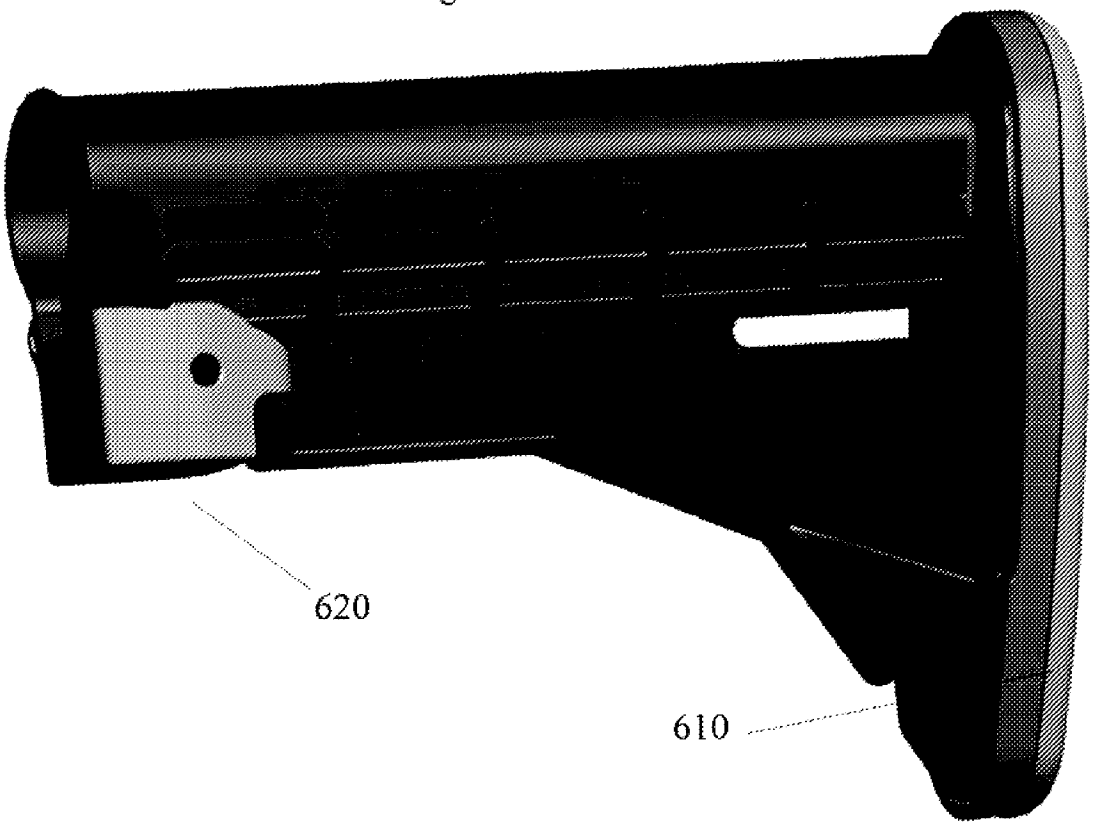
FIG. 6K is a drawing of a butt stock for the Colt® M4 5.56 mm Carbine with an attached IR sensor and sensor mount and attached butt stock sensor and sensor mount in accordance with one embodiment of the present invention.
Figure 7C:
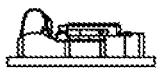
FIG. 7C is a drawing of a rear view of an ejector side wiring harness appropriate for the Colt® M4 5.56 mm Carbine in accordance with one embodiment of the present invention.
Figure 7E:
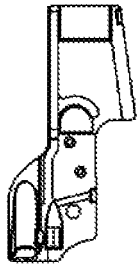
FIG. 7E is a drawing of a side view of an ejector side wiring harness appropriate for the Colt® M4 5.56 mm Carbine in accordance with one embodiment of the present invention.
Figure 7B:
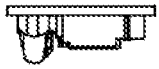
FIG. 7B is a drawing of a front view of an ejector side wiring harness appropriate for the Colt® M4 5.56 mm Carbine in accordance with one embodiment of the present invention.
Figure 7D:
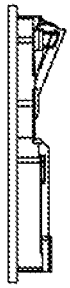
FIG. 7D is a drawing of a bottom view of an ejector side wiring harness appropriate for the Colt® M4 5.56 mm Carbine in accordance with one embodiment of the present invention.
Figure 7A:
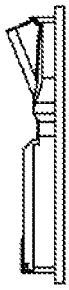
FIG. 7A is a drawing of a top view of an ejector side wiring harness appropriate for the Colt® M4 5.56 mm Carbine in accordance with one embodiment of the present invention.

The butt stock sensor attachment 610 and butt stock IR sensor attachment 620 may be attached to a weapon through a variety of means. An exemplary embodiment for means of attaching the butt stock sensor attachment 610 and IR butt stock sensor attachment 620 to a weapon is by way of placing a first adhesive compound or tape between the butt stock sensor attachment 610 and the butt stock of the weapon and a second adhesive compound or tape between the IR butt stock sensor attachment 620 and the butt stock of the weapon. Other means of securing the butt stock sensor attachment 610 and butt stock IR sensor attachment 620 to the butt stock include, but are not limited to, "snapping" on a properly sized butt stock sensor attachment 610 and butt stock IR sensor attachment 620 to the butt stock of a weapon. FIG. 6K shows an exemplary placement of the butt stock sensor attachment 610 and butt stock IR sensor attachment 620 on a butt stock of a weapon.

The aforementioned sensor locations are just examples of some of the locations to which a sensor and sensor attachment could be affixed. One of ordinary skill in the art would understand that there are multiple locations a sensor and sensor attachment could be affixed to a weapon and embodiments of the present invention are contemplated for use with any location on a weapon where a sensor attachment is possible. Other locations where a sensor and sensor attachment could be affixed to a weapon include, but are not limited to, an ejector, a magazine, a magazine receiver, a trigger, a weapon attachment (e.g., an under barrel grenade launcher, any manner of attached optics, etc.), a component of a weapon attachment (e.g., the trigger of an under barrel grenade launcher, etc.) and a magazine release button.

With respect to the wiring harness, according to an embodiment of the invention, a wiring harness is developed by creating a 3D model of a wiring harness appropriate for the weapon that the wiring harness will attach to. Once the 3D model of the wiring harness is created, wire routing and sensor holder pockets are added to the 3D model. The wiring harness is formed in such a manner as to attach to the weapon in a non-intrusive manner. It should be understood that non-intrusive means that the wiring harness if formed in such a manner as not to interfere with the usual operation of the weapon (e.g., firing, reloading, spent casing ejection, etc.).

According to embodiments of the present invention, the wiring harness and second 3D model also have spaces for running data transmission components and sensor interaction components. Data transmission components may include, but are not limited to, wires for transmitting data received from the sensors or sensor interaction components to a control unit and wireless data transmission components (e.g., RFID, Bluetooth, wireless network) for transmitting data received from the sensors or sensor interaction components to a control unit. Sensor interaction components include, but are not limited to, components capable of detecting changes in magnetic fields, components capable of detecting changes in electrical current, components capable of detecting changes in pressure and components capable of detecting changes in angle/pitch/elevation or other directional positioning.

Figure 8B:
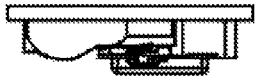
FIG. 8B is a drawing of a front view of a selector side wiring harness appropriate for the Colt® M4 5.56 mm Carbine in accordance with one embodiment of the present invention.
Figure 8C:
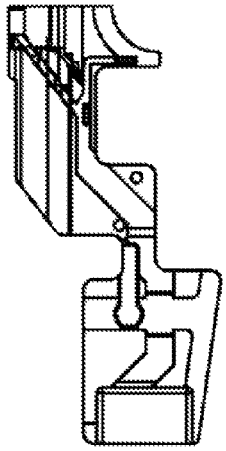
FIG. 8C is a drawing of a side view of a selector side wiring harness appropriate for the Colt® M4 5.56 mm Carbine in accordance with one embodiment of the present invention.
Figure 8A:
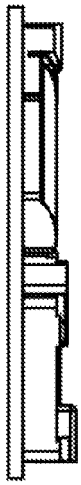
FIG. 8A is a drawing of a top view of a selector side wiring harness appropriate for the Colt® M4 5.56 mm Carbine in accordance with one embodiment of the present invention.

An exemplary embodiment of a wiring harness is depicted in FIGS. 7A-7E and 8A-8C. FIGS. 7A-7E show a multitude of views of a wiring harness to be mounted on the ejector side of a Colt® M4 5.56 mm Carbine in accordance with one embodiment of the present invention. FIGS. 8A-8C show a multitude of views of a wiring harness to be mounted on the selector side of a Colt® M4 5.56 mm Carbine in accordance with one embodiment of the present invention. One of ordinary skill in the art would understand that there are various locations acceptable for receiving and securing one or more wiring harnesses on a weapon and embodiments of the present invention are contemplated for use with any location on a weapon where a wiring harness is possible.

According to an embodiment of the invention, the wiring harness can be designed and attached to a weapon in a manner that acts to protect the weapon from damage and scratches. In this regard, the wiring harness, sensor attachments and control unit can be designed and attached in such a manner as to protect a weapon from damage and scratches, protecting the weapon and potentially extending the life and functionality of the weapon. In an exemplary embodiment of the present invention, the wiring harness, sensor attachments and/or control unit can have an external shell made from a impact resistant material (e.g., plastic, rubber, silicone) that absorbs shock and wear a weapon may receive from usage.

With respect to the control unit, according to an embodiment of the invention, a control unit may contain, but is not limited to, components for interacting with simulated training systems or real world devices (e.g., buttons, dials, joysticks), components for receiving data from sensors or wiring harnesses, components for processing data, components for providing power to the various components of the present invention (e.g., batteries, capacitors) and components for transmitting data to remote computing devices.

The control unit may be attached to the weapon in numerous locations, including, but not limited to, mounted to a Picatinny rail. According to an embodiment of the present invention, as depicted in FIGS. 9A-9D, a control unit may take the form of a forward mounted grip.

Figure 9A:
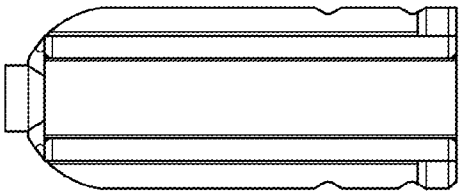
FIG. 9A is a drawing of a top view of a control unit appropriate for attachment as a forward grip on a rail based mounting system.
Figure 9B:
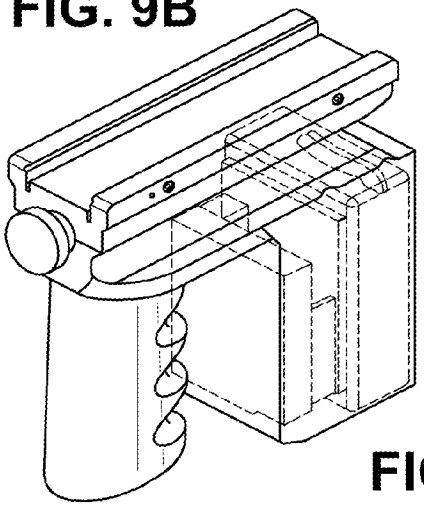
FIG. 9B is a drawing of a view of a control unit appropriate for attachment as a forward grip on a rail based mounting system.
Figure 9C:
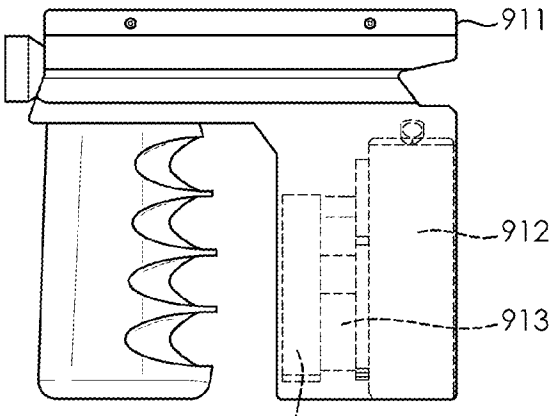
FIG. 9C is a drawing of a side view of a control unit appropriate for attachment as a forward grip on a rail based mounting system.
Figure 9D:
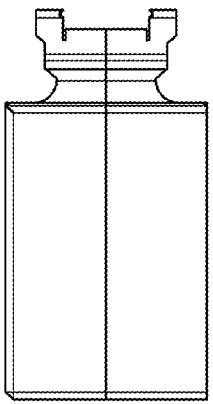
FIG. 9D is a drawing of a front view of a control unit appropriate for attachment as a forward grip on a rail based mounting system.

A exemplary control unit, as depicted in FIG. 9C, may consist of a groove 911 capable of attaching to a Picatinny rail or other rail mount system under the barrel of a weapon, a forward grip handle 915, and a forward control handle 916.

According to an embodiment of the present invention, The forward grip handle 915 may contain one or more user controls (e.g., buttons, dials, joysticks) that allow for interaction with a simulated training system (e.g., instruct simulated avatar to open a door, mount/dismount a vehicle) or a real world device (e.g., control of a remote controlled vehicle). Actions or events created through the use of the user controls are sent to the components in the control unit that handle processing or transmitting data.

According to an embodiment of the present invention, The forward control handle 916 may contain, but is not limited to, components for receiving data from sensors or wiring harnesses, components for processing data 913, 914, components for providing power to the various components of the present invention 912 (e.g., batteries, capacitors) and components for transmitting data to remote computing devices 913, 914.

Figure 10:
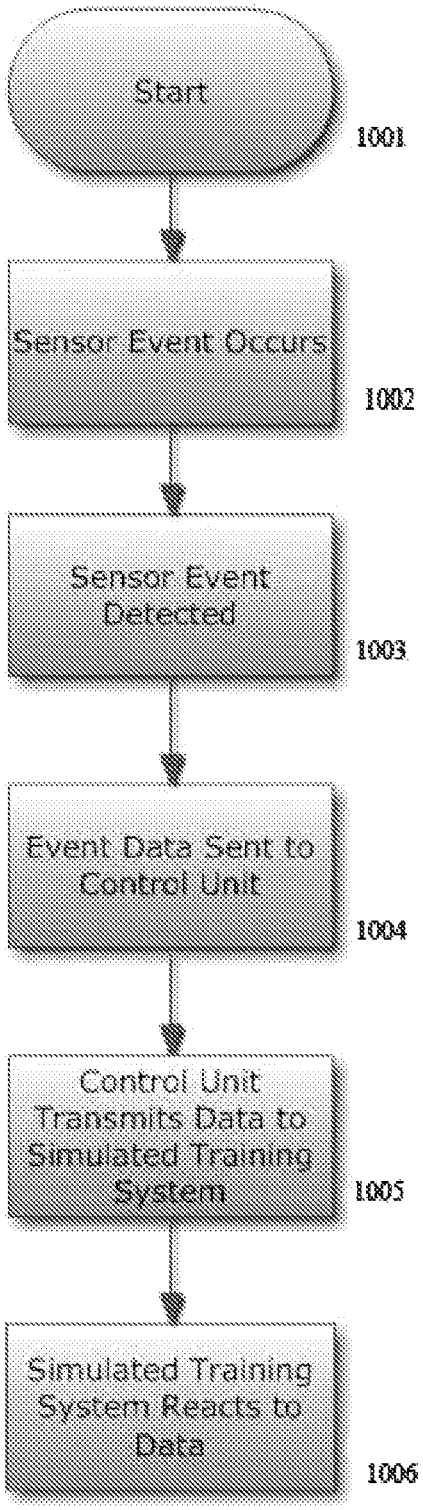
FIG. 10 illustrates a flow diagram in accordance with a method of the present invention.

FIG. 10 depicts the flow of an interaction between an exemplary embodiment of the present invention and a simulated training system. At step 1001, a weapon, in this example a Colt® M4 5.56 mm Carbine, has previously been outfitted with a weapon instrumentation system according in accordance with an embodiment of the present invention as described above. The weapon has been modified with at least a magnetic sensor and sensor attachment attached to the selector switch, a wiring harness and a control unit.

At step 1002, a sensor event occurs. In this example, the selector switch is changed from its starting point of "safety" to "semi-auto". The change in position of the selector switch also changes the position of the magnetic sensor and sensor attachment causing a sensor event.

In the next step 1003, the sensor event created in step 1002 is detected. In this case, the change in the magnetic field caused by the movement of the magnetic sensor and sensor attachment is detected by sensor interaction components in the wiring harness.

In step 1004, the detected sensor event is transmitted to the control unit. In our example, the data relating to the change in the magnetic field caused by the changing in position of the selector switch is relayed to the control unit via a wired connection between the wiring harness and the control unit.

In step 1005, the control unit transmits data to a simulated training system. In our example, the control unit has received data it received from the wiring harness regarding the change in position of the selector switch. This data is then sent wirelessly to a remote computing device that is controlling the simulated training system using a Bluetooth connection. Optionally, prior to transmitting the data to the simulated training system, the control unit may process and edit the data to be sent. Advantageously, a control unit used in this manner will reduce the load on the server(s) of the simulated training system by providing off-board processing of data.

In step 1006, the simulated training system reacts to the data it has received from the control unit mounted on the modified weapon. In our example, the simulated training system receives the data pertaining to the change in selector switch position and reacts by noting that the modified weapon is now in a state where it is capable of firing rounds. Prior to detecting this change, the simulated training system may have ignored any sensor data related to the pulling of the trigger of the modified weapon as the simulated training system registered the modified weapon as in "safety" mode.

The invention is not restricted to the details of the foregoing example. Embodiments of the present invention are contemplated for use with any simulated training system.

Additionally, according to embodiments of the present invention, the system and method herein provided has application in live fire exercises and actual field use as well. Embodiments of the present invention include control units capable of recording live fire and field use of the modified weapon.

According to an embodiment of the present invention, the control unit would record sensor events based on the time they occur. This data may be processed to form an entire timeline of how the weapon was used, including when the weapon was fired, what direction/angle/elevation the weapon was fired in and any other sensor event available to a particular modified weapon.

According to an embodiment of the present invention, the system and method herein described can be used to modify articles of manufacture other than weapons. Examples include, but are not limited to, paintball guns, video game controllers and simulated weapons. In each example, the resulting modified article of manufacture could be used to interact with a simulated system (e.g., gaming console, simulated training system, remote computing device) or record usage data (e.g., the usage of a paintball gun on a paintball course).

Figure 11:
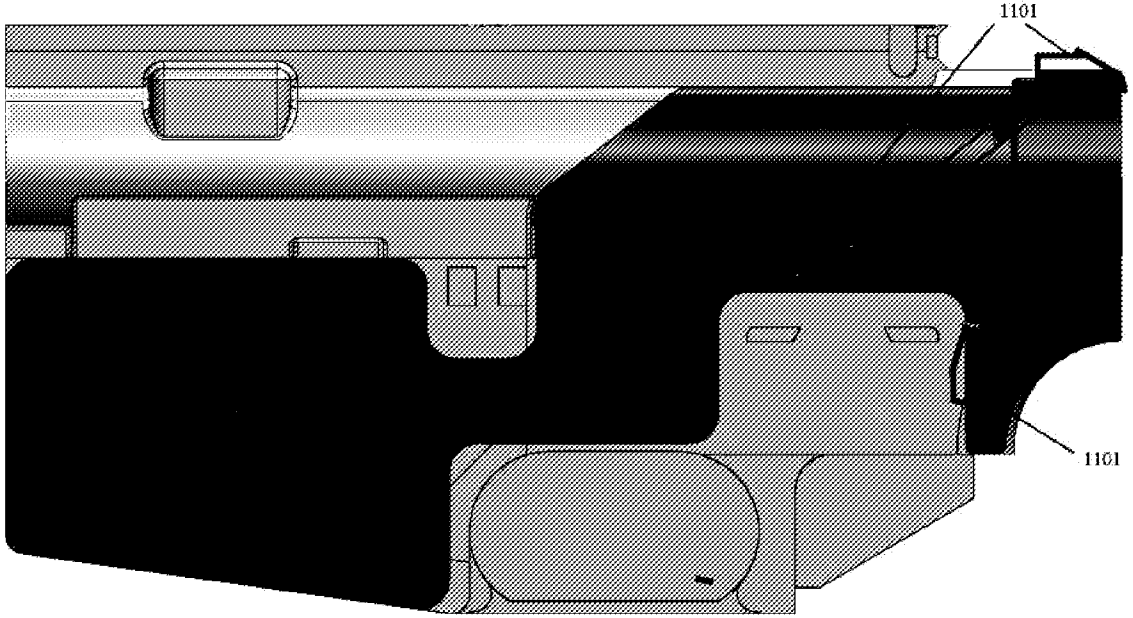
FIG. 11 is a drawing of potential locations for sensors, sensor attachments and sensor interaction components on the ejector side of a Colt® M4 5.56 mm Carbine in accordance with one embodiment of the present invention.
Figure 12:
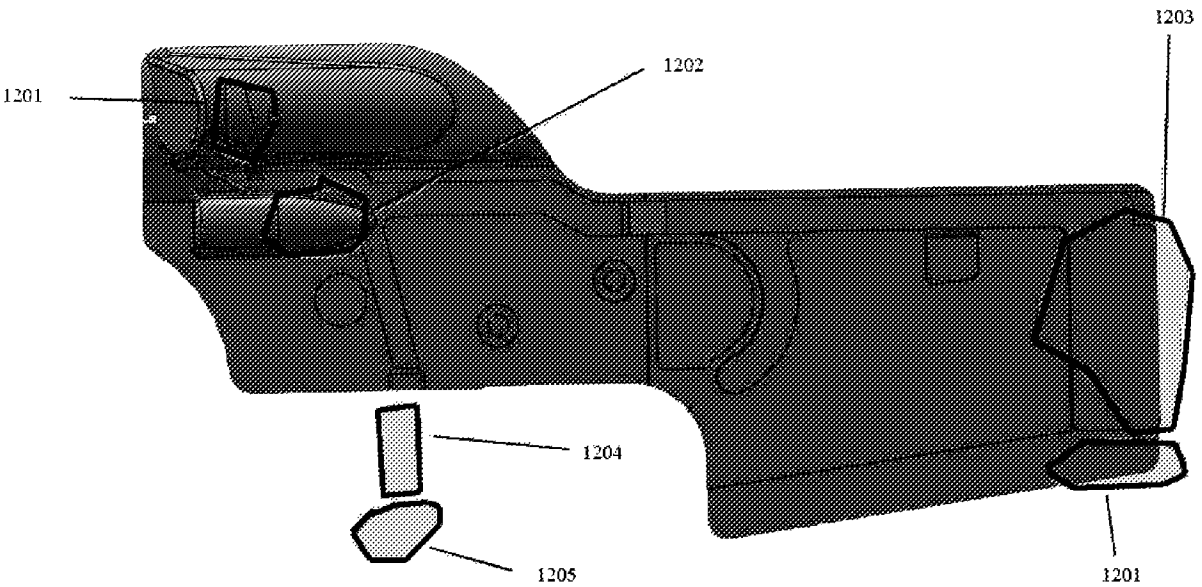
FIG. 12 is a drawing of potential locations for sensors, sensor attachments and sensor interaction components on the selector side of a Colt® M4 5.56 mm Carbine in accordance with one embodiment of the present invention.

FIGS. 11 and 12 are included to illustrate possible locations for mounting sensors, sensor attachments and sensor interaction components. FIG. 11 shows locations, according to an embodiment of the present invention, for mounting reed switches 1101 inside a selector side wiring harness. FIG. 12 shows locations, according to an embodiment of the present invention, for mounting reed switches 1201, IR detectors 1202, wiring between the wiring harness and the control unit 1203, trigger microswitch 1204 and an optical light sensor 1205.

It is understood that the above-described embodiments are illustrative of only a few of the many possible specific embodiments, which can represent applications of the invention. Numerous and varied other arrangements can be made by those skilled in the art without departing from the spirit and scope of the invention.

The invention claimed is:

1. A weapon modification and instrumentation system comprising:

one or more sensors, wherein said one or more sensors are attached to one or more operable components of a weapon without replacing existing components of the weapon, wherein said one or more operable components of a weapon are selected form the group consisting of a selector switch, a charger, a trigger, a butt stock, an ejector, a magazine, a magazine receiver, a magazine release button, and any combination of the foregoing, wherein said one or more sensors is configured to detect sensor events associated with said one or more operable components and provide operational data about said one or more operable components;

a wiring harness to be attached to one or more sides of a receiver of said weapon without replacing existing components of the weapon, wherein said wiring harness is able to read data from said one or more sensors; and a control unit communicatively connected to said wiring harness, wherein said control unit is capable of receiving said data from said wiring harness.

2. The system of claim 1 wherein said control unit is capable of storing said data.

3. The system of claim 1 wherein said control unit is capable of transmitting said data to a remote computing device.

4. The system of claim 1 wherein said control unit is capable of receiving data from a remote computing device.

5. The system of claim 4 wherein said control unit is capable of changing a functionality of the weapon.

6. The system of claim 1 wherein said wiring harness is made from an impact resistant material.

7. The system of claim 6 wherein said wiring harness made from said impact resistant material functions to reduce wear and tear on said weapon.

8. A method for modifying and instrumenting a weapon for recording or transmitting data related to the use of said weapon, the method comprising:

securing one or more sensors to one or more operable components on said weapon without replacing existing components of the weapon, wherein said one or more operable components of a weapon are selected form the group consisting of a selector switch, a charger, a trigger, a butt stock, an ejector, a magazine, a magazine receiver, a magazine release button, and any combination of the foregoing, wherein said one or more sensors is configured to detect sensor events associated with said one or more operable components and provide operational data about said one or more operable components;

securing a wiring harness to one or more sides of a receiver of said weapon without replacing existing components of the weapon, wherein said wiring harness is secured in such a manner to read data from said one or more sensors;

securing a control unit to said weapon without replacing existing components of the weapon; and connecting said wiring harness to said control unit, wherein said connection allows said data to be collected in and processed by said control unit.

9. The method of claim 8 wherein said one or more sensors include at least one magnetic sensor.

10. The method of claim 8 wherein said wiring harness is secured to the weapon by an adhesive.

11. The method of claim 8 wherein said control unit is a front mounted grip.

12. The method of claim 11 wherein said control unit is secured to the weapon by attaching said control unit to a rail.

13. The method of claim 8 wherein said wiring harness is made from an impact resistant material.

14. The method of claim 13 wherein said wiring harness made from said impact resistant material functions to reduce wear and tear on said weapon.

* * * * *